United States Patent [19]

Caferro

[11] Patent Number: 4,527,538

[45] Date of Patent: Jul. 9, 1985

[54] SELF-CONTAINED OVEN

[76] Inventor: Dennis Caferro, N. 3223 Market, Spokane, Wash. 99207

[21] Appl. No.: 608,945

[22] Filed: May 10, 1984

[51] Int. Cl.[3] ..... F24C 15/32

[52] U.S. Cl. ..... 126/21 R; 126/39 J; 126/19 R

[58] Field of Search ..... 126/21 R, 21 A, 39 R, 126/39 C-39 K, 40, 41 R, 19 R, 19 M; 165/185; 99/422

[56] References Cited

U.S. PATENT DOCUMENTS

| | | | |
|---|---|---|---|
| 336,837 | 3/1886 | Miller | 126/21 R |
| 339,228 | 4/1886 | Smith | 126/21 R |
| 533,498 | 2/1895 | Rowell | 29/160 |
| 1,346,666 | 7/1920 | Murphy | 126/21 R |
| 1,436,989 | 11/1922 | Lehmann | 126/21 R |
| 1,477,050 | 12/1923 | Faulk | 126/21 R |
| 1,536,244 | 5/1925 | Sussman | 126/21 R |
| 1,611,087 | 12/1926 | Sussman | 126/275 |
| 1,981,658 | 11/1934 | Mosshammer | 126/275 |
| 3,389,451 | 6/1968 | Speca et al. | 29/160 |
| 4,321,910 | 3/1982 | Devienne | 126/449 |

FOREIGN PATENT DOCUMENTS

| | | | |
|---|---|---|---|
| 346001 | 6/1960 | Switzerland | 126/39 J |

*Primary Examiner*—James C. Yeung

*Attorney, Agent, or Firm*—Wells, St. John & Roberts

[57] ABSTRACT

A self-contained oven using an intense source of radiant heat applied directly onto the bottom surface of a heat transfer grill that can directly support food or objects being heated. The grill includes a lower section having downwardly open hollow cells formed by intersecting metal walls, a solid metal plate capping the lower section, and a covering insulating section that can support the food or objects. A natural draft is permitted to flow through the oven chamber from an inlet leading to the area directly beneath the heat transfer grill. Warmed air and gas then flows in a convoluted path through the oven in convection currents to transfer heat to the food or objects.

12 Claims, 2 Drawing Figures

SELF-CONTAINED OVEN

FIELD OF THE INVENTION

This disclosure relates to self-contained ovens which use a concentrated heat source to warm air in an oven chamber to conduct heat to objects or food for baking, roasting, heating, drying or other purposes. It relates specifically to a novel heat transfer grill that efficiently spreads concentrated radiant heat energy throughout the grill structure and transfers the heat energy to natural draft currents within an oven.

BACKGROUND OF THE INVENTION

An oven typically comprises a heated chamber or compartment used for baking, roasting, heating, drying and similar purposes. Every oven includes an interior or exterior source of heat. Most ovens are basically conduction ovens, which transfer heat to objects by thermal conduction through a heating medium that is essentially static air or gas within the oven structure. The hollow oven interior is typically vented to prevent pressure buildup.

Convection ovens provide rapid heat transfer by using moving heated air or gas streams to transfer heat to objects within the oven. In conventional convection ovens, movement of the air or gas stream is artificially induced by fans or blowers. The moving air or gas within a convection oven accelerates transfer of heat to objects encountered by it.

One essential feature in any oven is the provision of uniform heat transfer to all portions of the object being heated. This is particularly important when cooking foods, since most cooking applications require even heat distribution to the food mass to achieve consistency in the finished product. While this can be accomplished by larger, stationary ovens typically found in commercial and residential kitchens, uniform heat distribution is much more difficult to accomplish in smaller units, particularly in portable ovens. Electric ovens make possible the use of larger area heating elements. Where electricity is unavailable, a flame heat source must be used to heat the oven. The large heat requirements necessary to achieve typical baking temperatures within an oven enclosure typically leads to wide variations in temperatures throughout the oven. Since the heat source is usually at the bottom of the oven, this usually results in foods being overcooked at the bottom of a pan or, conversely, being undercooked at the top of a pan.

A very rudimentary form of portable oven in use today simply comprises an open-bottom enclosure which is placed directly over a heat source such as a portable stove. In this arrangement, the bottom surfaces of pans within the oven are directly exposed to the rather intense heat of the covered stove. Uniform cooking in such an oven is impossible.

To better distribute heat throughout such a portable oven, a horizontal heat baffle is usually located at the bottom of the oven. It is typically interposed between the flame heat source and the food being cooked. Since the air within such an oven is essentially static, all transfer of heat within the oven occurs by conduction, and substantial temperature gradients will be encountered from one position to another within the oven.

The improvement disclosed herein arose from an effort to overcome these problems by providing a highly efficient heat distributor to spread the concentrated radiant heat supplied by portable heat sources, and to utilize natural convection currents to direct the heat uniformly about the objects in the oven.

BRIEF DESCRIPTION OF THE DRAWINGS

A preferred embodiment of this invention is illustrated in the accompanying drawings, in which.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
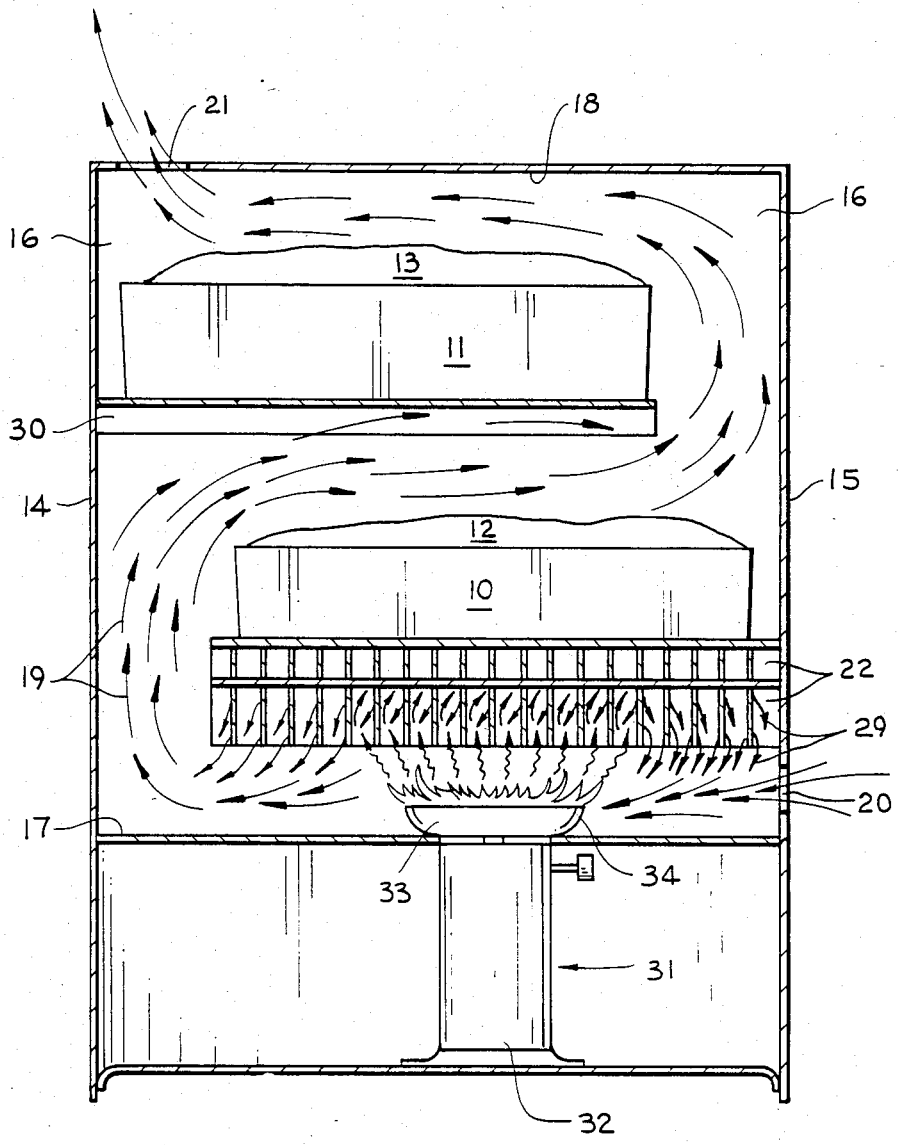
FIG. 1 is a cross-sectional view through an oven made according to this invention, illustrating the flow of heat energy and gases within the oven interior during its operation.

FIG. 1 illustrates a practical embodiment of a self-contained convection oven incorporating the features of this disclosure. The oven utilizes natural draft convection current to direct heat to food or objects within it, illustrated by two pans 10 and 11 containing food materials 12 and 13, respectively. While the oven will be described specifically with respect to cooking of foods, it is to be recognized that it is capable of other applications relating to heating or drying of non-food materials.

The oven includes a hollow chamber or enclosure formed between side walls 14 and 15, a rear wall 16, a bottom wall 17 and a top wall 18. The enclosure shown in FIG. 1 would be completed by a hinged or moveable front door (not shown) for access to the oven interior.

The enclosure has an exteriorly vented inlet 20, shown at the lower portion of side wall 15, and an exteriorly vented outlet 21, shown in the top wall 18 adjacent to side wall 14. Inlet 20 and outlet 21 permit free flow of air and combustion gases (if any) along a convoluted path through the interior of the oven.

Figure 2:
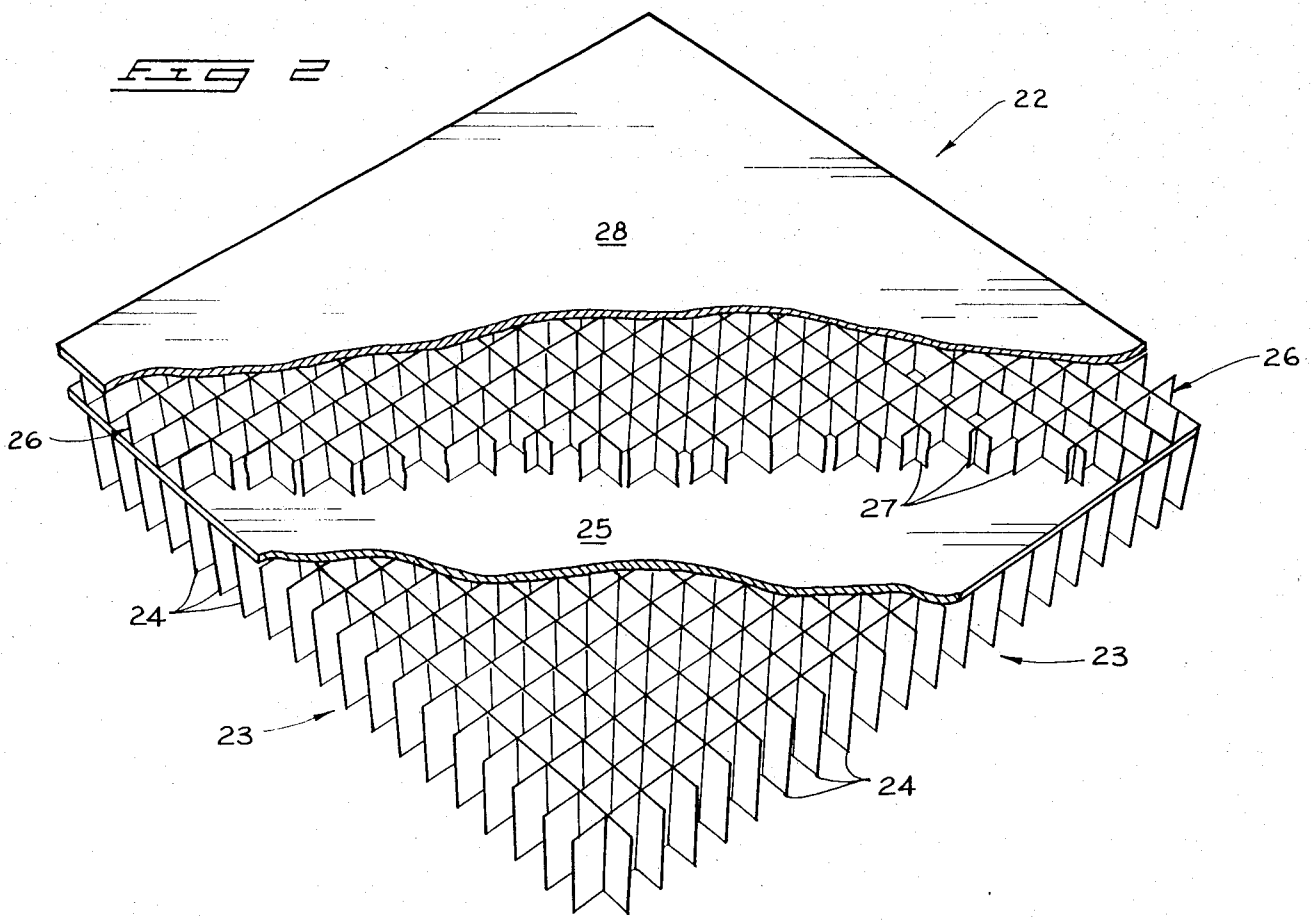
FIG. 2 is a perspective view of one form of the disclosed heat transfer grill, with the layered components partially broken away for illustration purposes.

The key structural improvement in the present oven resides in the novel heat transfer grill 22 shown assembled in the oven in FIG. 1 and shown as a separate subassembly in FIG. 2. Grill 22 includes a lower section 23 presenting a plurality of downwardly open hollow cells formed between intersecting upright metal walls 24. The cells in the lower section 23 of grill 22 are capped by a solid transverse metal plate 25. Grill 22 also includes an upper section 26 mounted to the metal plate 25 and overlying its lower section 23. The upper section 26 presents a plurality of hollow cells formed between intersecting upright solid metal walls 27. A second transverse solid metal plate 28 caps the upper section 26 of grill 22. The components of grill 22 can be welded or bolted to one another to form a unitary assembly in which they structurally reinforce each other to withstand the heat to which the grill is subjected.

The grill 22 is supported across the interior of the oven enclosure in a transverse horizontal position. In the embodiment shown in FIG. 1, it extends from the front of the enclosure to the supporting rear wall 16, and from side wall 15 to a position spaced slightly from the opposite side wall 14. The upper surface of grill 22, illustrated by plate 28, serves as a supporting shelf for the lower pan 10. A second shelf 30, extending from side wall 14, serves as a supporting shelf for a second pan 11. It extends from side wall 14 to a position spaced inwardly from side wall 15.

Radiant heat means is located within the oven enclosure and is positioned directly beneath grill 22 for directing radiant heat to grill 22 from below. The radiant heat means can comprise any heat source capable of supplying adequate quantities of heat to the interior of the oven for convection heating purposes as detailed below. Such sources might include hot coals, burning charcoal, liquid or gas stove burners, or electrical heating elements. The illustrated heat source is shown as a conventional portable gas stove 31 including a supporting fuel tank 32 and an upwardly directed burner 33. The details of stove 31 are conventional and not essential to an understanding of the present disclosure.

The oven enclosure also includes a horizontal heat deflector 34 spaced from bottom wall 17 and surrounding the burner 33. It deflects heated air toward the upper portions of the oven, and assists in channeling the natural flow of air and gases through the lower portions of the oven.

Grill 22 is positioned within the oven as the upper boundary of a gaseous path leading from the enclosure inlet 20 to the burner 33 and from the burner 33 to the enclosure outlet 21. As illustrated by the larger arrows 19 depicting gaseous flow in the oven enclosure shown in FIG. 1, the air and gases of combustion from inlet 20 and burner 33 pass across the bottom of grill 22, upwardly along wall 14, across the space bounded between grill 22 and shelf 30, upwardly along side wall 15, across the spaced bounded between shelf 30 and top wall 18, and finally exit through outlet 21. This movement or draft occurs naturally as a result of the heat transfer from burner 33 and grill 22 to the moving stream of fresh air entering the oven through inlet 20, as depicted by the smaller arrows 29.

The details of grill 22 can be best understood from a study of FIG. 2. Functionally, the lower section 23 of grill 22 serves as a heat conducting grid that is warmed by the radiant energy directed to its center from burner 33. The lower section 23 in turn spreads the heat throughout its structure by conduction and warms the moving stream of air and gases which comes into contact with its surfaces.

The upper section 26 of grill 22 serves as a thermal insulator to minimize direct vertical conduction of heat through grill 22 from burner 33. Efficient thermal insulation is achieved by utilizing the interiors of the cells in the upper section 26 as dead air spaces. While air is preferably entrapped between the two plates 25 and 28 as illustrated, it is possible to provide a separate lower plate sandwiching the upper section 26 together with the upper plate 28. It is also possible to use the bottom surface of the pans 10 resting on the walls 27 as the upper capping plate, assuming that they are suitably flat.

The walls 24 and 27 and plates 25 and 28 used in the grill structure 22 must be made of materials having relatively high thermal conductivity properties and sufficient structural strength in the grill assembly to maintain the desired shelf configuration within the oven enclosure under the elevated operating temperatures to which it will be subjected. The utility of this structure depends upon the grill's heat transfer characteristics, which must effectively disburse the intense heat radiated from burner 33. While the material used in the grill might have a melting temperature below the flame temperature of burner 33, the structural integrity of grill 22 can still be maintained by the thermal conductivity characteristics of the total grill structure.

In an actual working example tested to prove the concept of this oven, the grill sections 23 and 26 were produced from aluminum grids of the type utilized within existing designs for recessed ceiling lighting fixtures. Both sections contained a plurality of continuous wall members (24 or 27) arranged in two perpendicularly intersecting sets that extended the full length and width of the grill 22, respectively. These walls were spaced one-half inch apart, thereby presenting a series of square cells measuring one-half inch across each side.

In order to assure adequate conductive surfaces in the lower section 23 of grill 22 to disburse all of the heat to which it is subjected, its walls 24 preferably have a height greater than the cell width. In the specific example illustrated and tested, the vertical height of walls 24 was one inch. Adequate thermal insulation was provided by the structure of upper section 26 using a vertical height of one-half inch along its walls 27.

The physical construction of the individual grid sections 23 and 26 in grill 22 is identical to the fabrication of ceiling lighting grills. The two perpendicular sets of walls used in each grid are oppositely slotted from their top and bottom surfaces and cold-welded to one another at their intersections as they are pressed oppositely together. Structurally similar rectangular grids are described in U.S. Pat. No. 533,498 to Rowell, patented Feb. 5, 1895 and in U.S. Pat. No. 3,389,451 to Speca et al, patented June 25, 1968. These prior patented disclosures are hereby incorporated into this disclosure by reference as illustration of alternative grid fabricating techniques applicable to this disclosure. It is to be understood that the grid can be produced by many equivalent fabricating methods.

The plate 25 and upper section 26 are preferably fixed across the top of the lower section 23 in grill 22 to provide structural reinforcement to walls 24. The reinforcement provided by this attached structure assists in counteracting internal forces within walls 24 that might warp or buckle them. The horizontal wall 24 also serves as a radiant heat barrier and horizontal heat conductor.

The key to the observed operation of the illustrated convection oven lies in the structural design of the heat transfer grill 22. The grill 22 shown in detail in FIGS. 1 and 2 serves as an extremely efficient heat transfer structure capable of dissipating large amounts of heat rapidly across its width and length. Because of the large amount of surface area presented to the stream of gas and air passing beneath it, this heat can be readily and evenly transferred to the gas and air flowing upwardly through the oven interior.

The heat transfer efficiency of the grill 22 is determined by five variables:

(1) The thermal conductivity of the material used in walls 24 and 27 and in plates 25 and 28;

(2) The surface area presented in the grill;

(3) The wall thicknesses in walls 24 and 27 and in plates 25 and 28;

(4) The maximum temperature differential between the heated centers and cooled extremities of grill 22.

(5) The type of flow phenomenon exhibited by the gas and air passing across the lower surfaces of grill 22.

With respect to the above variable factors, the grill structure adapted to the oven application from ceiling lighting grids exhibits high thermal conductivity because of its aluminum content. Other highly conductive metals, such as copper, can be substituted in place of aluminum. The grill presents a large surface area in relation to its total volume because of the cellular structure formed by walls 24 and 27. The wall thickness of the metal grids is relatively thin. Because of the high thermal conductivity of the metal materials used in the grids, the total temperature differential across the grid is relatively high. The type of air flow that results across the heated grill is essentially turbulent, and definitely not laminar.

The heat transfer efficiency of the grill shown in FIGS. 1 and 2 can be quantitatively evaluated in relation to the heat transfer potential of an available outdoor oven using a 16 gauge steel plate placed directly over a portable flame stove serving as a heat source for the oven. The heat transfer characteristics of the grill and plate will be compared according to the following formula and common assumptions:

$$H = \frac{KA\,(T_2 - T_1)}{L}$$

where H=the heat transfer potential in Kilowatts; K=a thermal conductivity Constant for the component material; A=the surface area of the structure; $T_2-T_1$=the maximum temperature differential across the structure; and L=the wall thickness in the structure.

The above formula can be applied to determine the heat transfer potential of the existing oven using a steel plate placed directly over the heat source as follows:

$K$ = 0.04 (Constant for Steel)
$A$ = Assume 1 sq. ft. (or 2 sq. ft of surface area .186m$^2$)
$(T_2 - T_1)$ = Assume 100° C.
$L$ = .062 in. or .0016 m.

$$H = \frac{(.04)\,(.186)\,(100)}{.0016} = 465 \text{ kw.}$$

Similarly, a one square foot aluminum section of the heat transfer grill 22 shown in FIGS. 1 and 2 can be analyzed to determine its heat transfer potential as follows:

$K$ = 0.2 (Constant for Aluminum)
$A$ = 1 sq. ft. cross section but grill exhibits 18 sq. ft. (1.488 m$^2$) of surface area (Assume this transfer grill to have ½" square by 1½" deep cell structure plus (2) 1' × 1' horizontal cap plates)
$T_2 - T_1$ = Assume 100° C.
$L$ = .025" or .00064 m.

$$H = \frac{(.2)\,(1.488)\,(100)}{.00064} = 46{,}500 \text{ kw}$$

From the above comparison, it can be seen that the potential for heat transfer in the grill in the enclosed drawings is of a magnitude at least 100 times greater than that of the solid plate used in the prior existing product. It must also be noted that the fifth variable, flow phenomenon, works in favor of the structure of grill 22, in comparsion to a flat solid plate. The uneven nature of the bottom surface of the grill presented by the open cells formed between walls 27, and the uneven air turbulence that will be encountered by fresh air from inlet 20 as it passes beneath grill 22, will create turbulence in the flowing air path of an uneven and generally unpredictable nature. This turbulent air movement will increase the rate of transfer of heat from the exposed metal surfaces to the air coming into contact with them.

The superior heat transfer characteristics of grill 22 and the resultant turbulent flow phenomenon in the flowing air and gas passing through the oven creates a demand for makeup air in the oven area beneath grill 22. The heat transfer to the air causes it to tend to rise more rapidly within the oven and thereby increases the volume of fresh air drawn through inlet 20 by natural convection currents.

In actual practice, food placed in pans resting on the upper plate 28 of the grill 22 have been found to be more rapidly cooked at their upper surfaces than at the bottom of the supporting pan. This can be attributed to the efficient transfer of heat in the heat conducting lower section 23 of grill 22, the efficient heat disbursal and insulating properties of the upper section 26 of grill 22, and the relatively fast moving stream of hot air and gas that flows across the top of the food in pan 10 as it passes beneath the shelf 30. Obviously, more even cooking occurs with respect to food in the upper pan 11, since its upper and lower surfaces are contacted by the same flowing stream of hot air and gases moving toward outlet 21.

The observed operation of grill 22 is particularly startling in view of the fact that it can be effectively manufactured from aluminum. Despite the fact that the aluminum used in the construction of grill 22 has a melting temperature of approximately 900° F. and is subjected to radiant energy from a flame having a temperature of approximately 1200° F., no melting or structural failure in the grill 22 has been observed in actual practice. This can be attributed to the size proportions between the burner 33 and the large surface area content within grill 22, plus the use of inlet and outlet cross-sectional areas in the enclosure capable of supplying a draft of air and gases through the oven sufficient to assure heat transfer from grill 22 to the stream of air and gas sufficient to maintain the maximum temperature of the material within the grill 22 below its melting temperature.

As a rough example of the size relationship between burner 33 and grill 22, a four-inch circular flame directed onto a twelve-inch square grill would cover approximately 8.6% of the total lower grill area. It can be readily seen that there is a substantial amount of metal surface area exposed to the moving stream of air and not directly contacted by the hot flame. This extremely large "radiator" surface permits the intense heat supplied to the oven to be rapidly spread across the grill areas and transferred to the moving stream of air and gas.

This disclosure identifies the oven shown in FIG. 1 as a "convection oven", since it delivers heat to food or objects by use of a rapidly moving stream of air or gas. It must be understood, however, that the disclosed oven does not use the components normally associated with conventional convection ovens—namely, a fan-supported circultating system, a relatively large cooking chamber to faciliate air circulation, and a heat source physically isolated from the grillwork that supports the food or objects being heated. In the oven shown in FIG. 1, heat is circulated throughout the oven without using a fan or blower. The interior chamber in the oven can be relatively small in comparison to the volume of food or objects being cooked. The heat source is in direct contact with the grillwork supporting the food or objects being heated.

This oven is particularly adaptable to portable use, but can obviously be designed in larger, stationary ovens as well. It provides a relatively simple, lightweight and compact oven for field use in warming or cooking foods. Experimental tests to date have shown the oven to be superior in cooking efficiency and performance to much heavier, more costly and more complex competitive products.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A self-contained oven utilizing natural draft currents to transfer heat to an object within the oven, comprising:

a hollow enclosure having an exteriorly vented inlet and an exteriorly vented outlet;

a transverse horizontal grill located within the interior of the enclosure;

radiant heat means positioned directly beneath the grill for directing radiant heat energy onto the grill from below;

said grill comprising a lower section presenting a plurality of downwardly open hollow cells formed between intersecting upright metal walls, the cells in said lower section being capped by a solid transverse metal plate, an upper section mounted to the metal plate and overlying said lower section, said upper section presenting a plurality of hollow cells formed between intersecting upright solid metal walls; and said grill being positioned within the enclosure as the upper boundary of a gaseous path leading from the inlet to said radiant heat means and from the radiant heat means to said outlet.

2. The self-contained oven of claim 1 wherein said grill further comprises:

a second transverse solid metal plate capping said upper section of the grill.

3. The self-contained oven of claim 1 wherein the elevational height of the lower section of said grill is greater than the horizontal spacings between its intersecting upright walls.

4. The self-contained oven of claim 1 wherein the lower section contains a plurality of continuous wall members arranged in two perpendicularly intersecting sets that extend the full length and width of the grill, respectively.

5. The self-contained oven of claim 1 wherein each of the upper and lower sections contains a plurality of continuous wall member arranged in two perpendicularly intersecting sets that extend the full length and width of the grill, respectively.

6. A heat transfer grill for disbursing radiant heat energy from a heat source adjacent to it, comprising:

a first section presenting a plurality of open hollow cells formed between intersecting metal walls, the cells in said first section being covered at one end by a continuous solid transverse metal plate surface;

a second insulating hollow section overlying said metal plate presenting a plurality of closed hollow cells formed between intersecting upright metal walls and covered at opposite ends by continuous solid metal plate surfaces.

7. The grill of claim 6 wherein each of the first and second sections contains a plurality of continuous wall members arranged in two perpendicularly intersecting sets that extend the full length and width of the grill, respectively.

8. An oven adapted to utilize natural draft currents to heat an object within the oven, comprising:

a hollow enclosure having an exteriorly vented inlet and an exteriorly vented outlet;

a transverse horizontal grill located within the interior of the enclosure adapted to be positioned directly above a heat source for directing radiant heat energy onto the grill from below;

said grill comprising a lower section presenting a plurality of downwardly open hollow cells formed between intersecting upright metal walls, the cells in said lower section being capped by a solid transverse metal plate, an upper section mounted to the metal plate and overlying said lower section, said upper section presenting a plurality of hollow cells formed between intersecting upright solid metal walls; and said grill being positioned within the enclosure as the upper boundary of a gaseous path leading from the inlet, across the bottom of the grill, and to said outlet.

9. The self-contained oven of claim 8 wherein said grill further comprises:

a second transverse solid metal plate capping said upper section of the grill.

10. The self-contained oven of claim 8 wherein the elevational height of the lower section of said grill is greater than the horizontal spacings between its intersecting upright walls.

11. The self-contained oven of claim 8 wherein the lower section contains a plurality of continuous wall members arranged in two perpendicularly intersecting sets that extend the full length and width of the grill, respectively.

12. The self-contained oven of claim 8 wherein each of the upper and lower sections contains a plurality of continuous wall members arranged in two perpendicularly intersecting sets that extend the full length and width of the grill, respectively.

* * * * *